United States Patent [19]

Kelly et al.

[11] Patent Number: 4,580,378

[45] Date of Patent: Apr. 8, 1986

[54] ANCHOR ASSEMBLY FOR TILT-UP WALL SECTION

[75] Inventors: David L. Kelly, Sacramento; Frank E. Turner, San Mateo, both of Calif.

[73] Assignee: The Burke Company, San Mateo, Calif.

[21] Appl. No.: 593,101

[22] Filed: Mar. 26, 1984

[51] Int. Cl.[4] ..... E04B 1/38; E04B 1/60

[52] U.S. Cl. ..... 52/125.5; 52/125.4; 52/701; 52/706; 52/707

[58] Field of Search ..... 52/125.5, 125.4, 706, 52/707, 701

[56] References Cited

U.S. PATENT DOCUMENTS

| | | | |
|---|---|---|---|
| 1,335,617 | 3/1920 | Solomon | 52/706 X |
| 3,078,621 | 2/1963 | Hinds | 52/125.4 |
| 4,000,591 | 1/1977 | Courtois | 52/707 X |
| 4,386,486 | 6/1983 | Holt et al. | 52/701 X |
| 4,437,642 | 3/1984 | Holt | 52/125.4 |

FOREIGN PATENT DOCUMENTS

| | | | |
|---|---|---|---|
| 805926 | 6/1951 | Fed. Rep. of Germany | 52/706 |
| 2223519 | 11/1973 | Fed. Rep. of Germany | 52/125.4 |

*Primary Examiner*—Alfred C. Perham
*Attorney, Agent, or Firm*—Limbach, Limbach & Sutton

[57] ABSTRACT

An anchor assembly for use in raising tilt-up wall sections which are cast in a horizontal position. The assembly includes an elongated steel anchor member supported in a vertical position on a base. A horizontal steel pin extends through an opening in the lower portion of the anchor member, with the pin and anchor member being retained in the base by two pairs of opposing resilient members which extend partially around the pin. A recess former is positioned over the upper end of the anchor member and is detachably locked to the anchor member by another pair of opposing resilient members which are extendable into a second opening in the upper portion of the anchor member. After the wall section is cast, the recess former is unlocked from the anchor member and removed from the wall section thereby providing access to the second opening of the anchor member. A hoist apparatus is then attached to the anchor member and the wall section is lifted to a vertical position, with the anchor pin preventing the anchor member from being pulled out of the wall section during the lifting process.

12 Claims, 8 Drawing Figures

ANCHOR ASSEMBLY FOR TILT-UP WALL SECTION

DESCRIPTION

1. Technical Field

The present invention relates generally to anchoring devices and more particularly to pin anchors and support stands for tilt-up wall slabs.

2. Background Art

Many buildings are constructed utilizing concrete wall slabs which are cast on sight in a horizontal position. The slabs are then tilted up to a vertical position to form a building wall or the like. Typically, anchors are imbedded in the walls during the casting process for use in raising such tilt-up walls.

U.S. Pat. No. 4,367,892 entitled "Lift System for Tilt-Up Walls" discloses an exemplary wall slab insert anchor and support stand. Although such anchor and support stand constitutes an advance in the art, shortcomings remain. By way of example, the steel anchor is configured such that relatively expensive casting techniques are required. In addition, the primary components are frequently held together by friction and, therefore, sometimes have a tendency to separate during the casting of the wall slab. The present invention overcomes such limitations in that the anchor can be economically fabricated from a metal stamping. The primary components are all held together in a single assembly using positive locking, therefore there is no tendency for the components to separate. These and other advantages of the present invention will be apparent to those having average skill in the art upon reading the following Best Mode For Carrying Out The Invention together with the drawings.

Disclosure Of The Invention

An anchor assembly for use in raising a horizontally-cast wall section to a vertical position is disclosed. The assembly includes an elongated anchor member, preferably stamped from a steel rectangular bar, having bores which extend through the lower and upper portions of the member. An anchor pin, preferably fabricated from a steel round bar, extends through the lower bore of the anchor member and serves to prevent the anchor assembly from being pulled out of the wall section during the tilt-up procedure.

The anchor member is supported in a generally vertical position in a base, the base preferably being made of polyethylene plastic or the like. The base typically is provided with a rectangular opening for receiving the lower portion of the anchor member. In the preferred embodiment, the base includes two pair of opposing resilient members disposed on opposite sides of the anchor member which extend at least partially around the anchor pin thereby detachably locking the anchor member to the base.

The anchor assembly further includes a recess former which is positioned over the upper end of the anchor member. The recess former forms a void in the wall section when the section is cast so as to provide access to the upper bore of the anchor member. In the preferred embodiment, the recess former includes a body section having an opening for receiving the top portion of the anchor member, and a pair of opposing resilient members which are adapted to pivot in and out of the upper bore of the anchor member. The recess former further includes a removable lid section which encloses the body section and which includes a pair of cam members which engage the resilient members and cause the resilient members to remain locked in the upper bore of the anchor member when the lid section is installed, thereby detachably locking the recess former to the anchor member.

One or more of the preferred embodiment anchor assemblies are positioned in the horizontal mold for casting the wall section. Concrete or the like is then poured into the mold, covering the anchor assemblies. When the concrete is cured, the lid section is removed thereby unlocking the recess former from the anchor member. Next, the body section is removed, thereby exposing the upper bore of the anchor member. A hoisting attachment is then positioned in the bore and the wall section is lifted to the vertical position.

BEST MODE FOR CARRYING OUT THE INVENTION

Figures 1, 2:
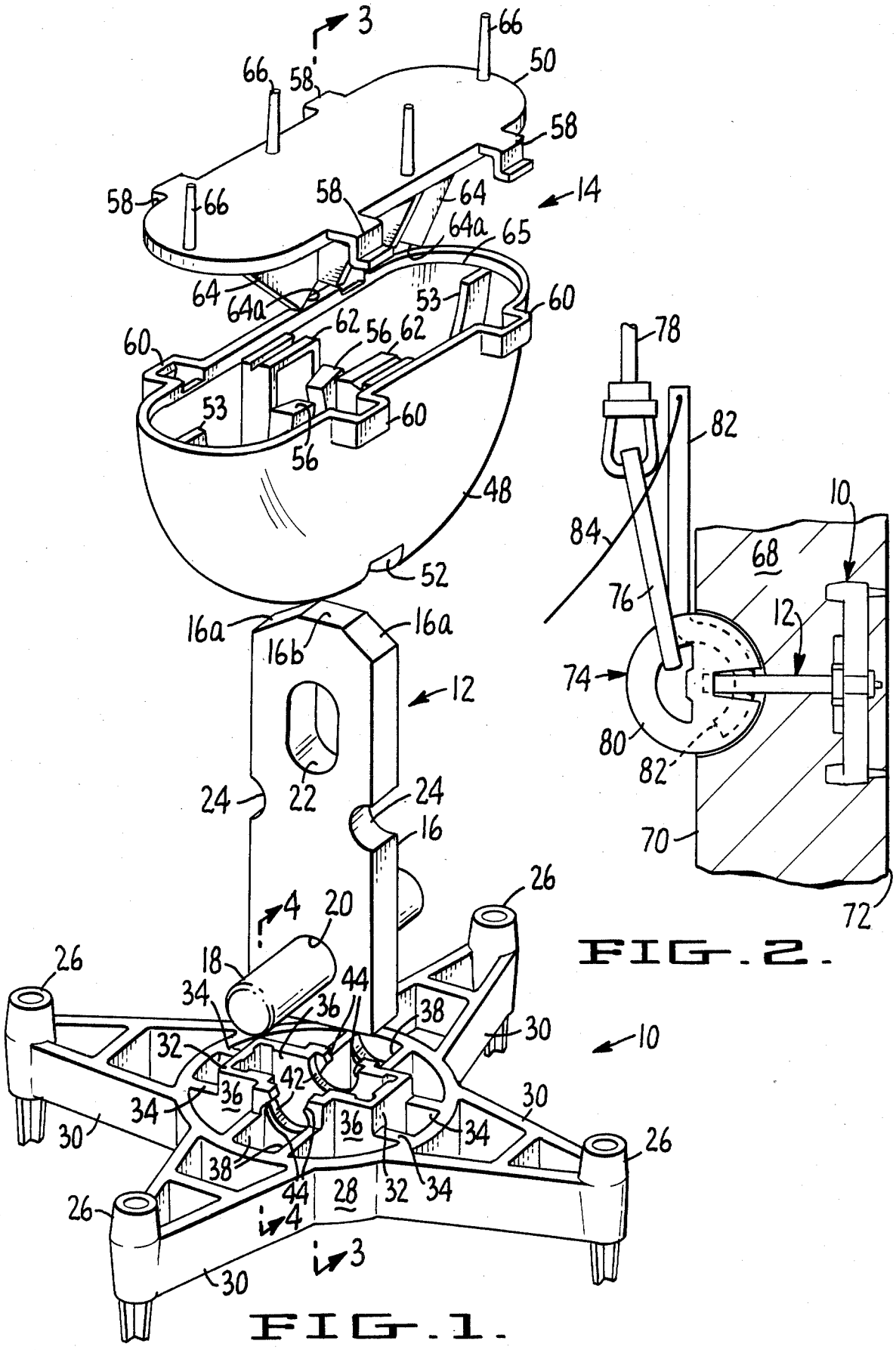
FIG. 1 is an exploded perspective view of the subject anchor assembly.
FIG. 2 shows the subject anchor assembly, with the recess former removed, installed in a concrete slab tilted vertical position.

Referring now to the drawings, particularly FIG. 1, the subject anchor assembly includes a base, generally designated by the numeral 10, an anchor, generally designated by the numeral 12, and a recess former, generally designated by the numeral 14.

Anchor 12 includes a vertical anchor member 16 and an anchor pin 18, generally transverse to member 16. Anchor member 16 is preferably stamped from a hot rolled rectangular cross-sectional steel bar and is typically 1.5 inches wide and 0.5 inches thick. The length of member 16 is selected depending upon the thickness of the wall slab in which the assembly is to be installed. For example, an anchor member length of approximately 7.25 inches would be used for a slab 8.00 inches thick.

Anchor member 16 is provided with a circular bore 20 which extends through the lower central portion of the member and a pair of semi-circular cutouts 24, located in the sidewalls of the member, which are disposed above the central region of the member. In addition, an elongated bore 22 is provided in the upper region of the member having a primary axis which coincides with the longitudinal axis of the anchor member. The upper portion of anchor member 16 includes a central horizontal surface 16*b* and a pair of converging outer surfaces 16*a*.

Anchor pin 18 is preferably manufactured from a steel round bar and is typically 2.8 inches in length and has a diameter which is typically 0.7 inches. Pin 18 is positioned within bore 20 of member 16 with the primary axis of the pin and member intersecting at right angles.

Base 10 is preferably molded polyethylene plastic to form an integral structure. Base 10 includes four vertical support legs 16 which are each coupled to a circular central section 28 of the base by a horizontal support member 30. Central section 28 includes four vertical wall members which define a generally rectangular-shaped recess for receiving the lower portion of anchor member 16. The vertical wall members include opposing wall members 32 which are each supported in central section 28 by pairs of parallel webs 34. The vertical wall members further include opposing wall members 36 which are each supported in the central section by two pairs of parallel webs 38. Gaps (not designated) are formed in each corner of the recess so as to limit stressing in the event an oversized anchor member 16 is used. Finally, as can best be seen in FIG. 3, the lower portion of the recess is defined by a horizontal rectangular panel 40 which interconnects wall members 32 and 36 and which includes a central downward projecting stop member 41 which is slightly spaced apart from support surface 72.

Opposing wall members 36 are each provided with a semi-circular cutout 42 for receiving anchor pin 18. Webs 38 each carry a projecting boss member 44 which is positioned adjacent cutouts 42. As can best be seen in FIG. 4, boss members 44 are positioned in opposing pairs on opposite sides of cutouts 42. Members 44 include arcuate surfaces which, together with cutout 42, define an anchor pin engaging surface which extends around the pin somewhat more than 180 degrees. Webs 38 have sufficient resiliency to allow boss members 44 to be urged apart a sufficient distance, when a downward force is applied to pin 18, so that the pin can pass between the members. When the pin is positioned fully within cutouts 42, boss members 44 return to their normal position applying a gripping force which retains the pin in a locked position.

Figures 3, 4, 5:
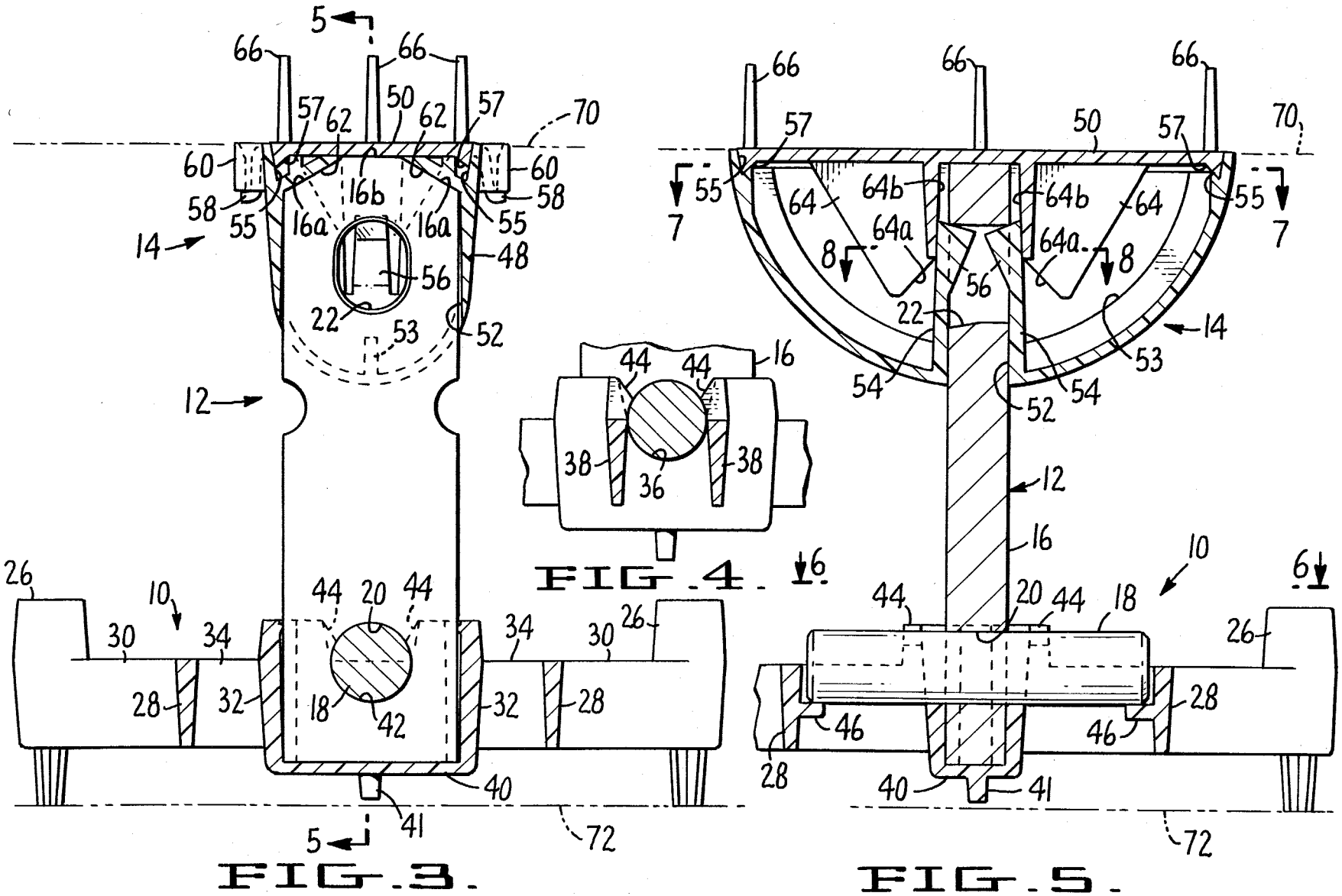
FIG. 3 is a cross-sectional elevation view of the subject assembly taken through section line 3—3 of FIG. 1.
FIG. 4 is a partial cross-sectional elevation view taken through section line 4—4 of FIG. 3 showing the manner in which the anchor pin is retained within the support stand.
FIG. 5 is a cross-sectional elevation view taken through section line 5—5 of FIG. 3.
Figure 6:
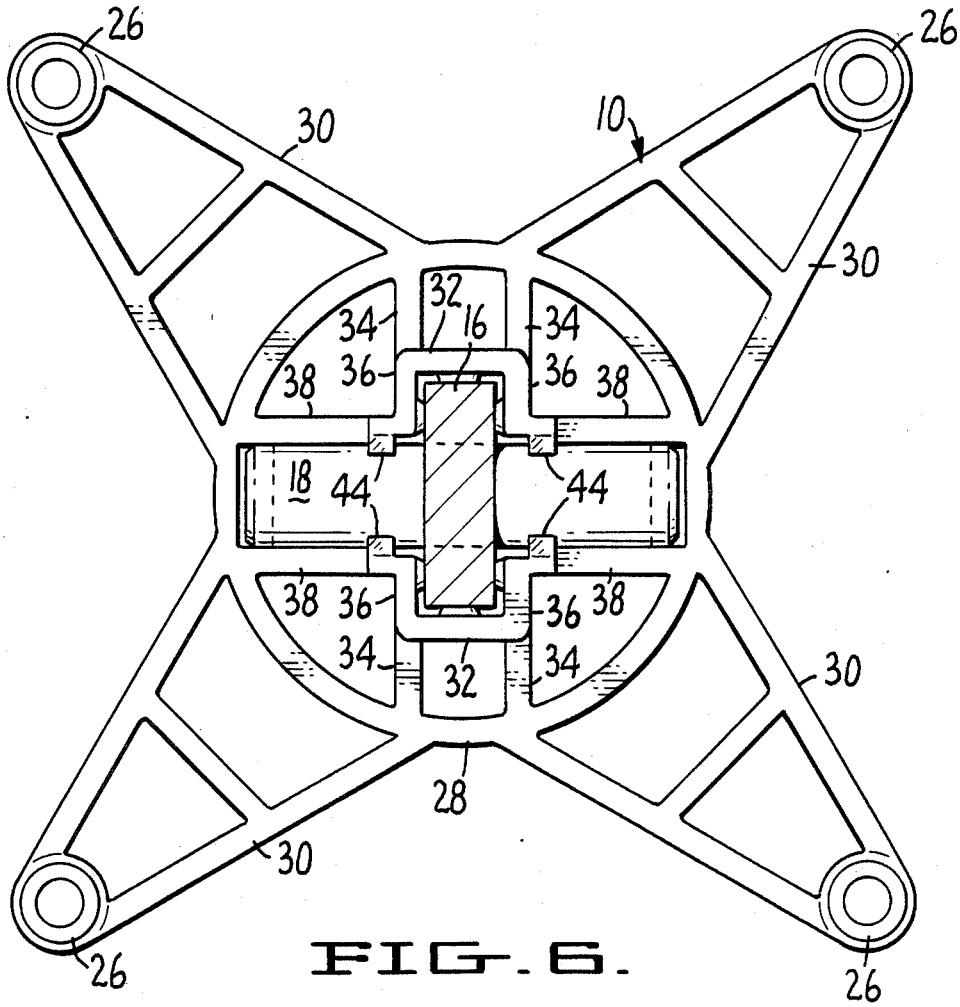
FIG. 6 is a cross-sectional plan view of the subject anchor assembly taken through section line 6—6 of FIG. 5.

As can best be seen in FIG. 5, when anchor pin 18 is in a locked position, the respective ends of the pin abut the inner surface of central section 28. Section 28 is also provided with a pair of semi-circular flanges 46 which extend partially around the anchor pin for providing further support for the pin.

Recess former 14, which is also preferably molded polyethylene plastic, includes a body section 48 and a removable lid section 50. Body section 48 has a generally circular cross-section along the principle axis as shown in FIG. 5 and a U-shaped cross-section along the secondary axis as shown in FIG. 3. A rectangular-shaped opening 52 is formed in the lower portion of section 48 for receiving anchor member 16. A reinforcing rib 53 extends along the inner surface of section 48 along the primary axis of the section between the upper lips of the body section down to opposite sides of opening 52. A pair of internal vertical opposing walls 54, transverse to the principle axis of the body section are positioned adjacent and on opposite sides of opening 52. Each wall 54 is provided with a locking member 56 having one end resiliently attached to the wall. Opposing locking members 56 both extend partially into opening 52 of the body section.

Body section 48 of the recess former further includes a pair of opposing anchor stop members 62 which extend from the upper portions of the sidewalls of the section over opening 52. As can best be seen in FIG. 3, stop members 62 form a pair of incline surfaces which engage the corresponding converging surfaces 16*a* at the top of anchor member 16 when the recess former is installed.

Lid section 50 of the recess former has a generally elongated eliptical profile adapted to mate with body section 48. Lid section 50 is provided with four spaced-apart lugs 58 which extend downwardly. Lugs 58 mate with corresponding receiving members 60 located on the upper edges of the body section, with each of the receiving members having an aperture for receiving the corresponding lug. As can best be seen in FIGS. 3 and 5, lid section 50 is provided with a downwardly-extending lip 57 which extends around the periphery of the underside of the section and which sealably engages the body section 48 in a corresponding groove 55.

Figure 7:
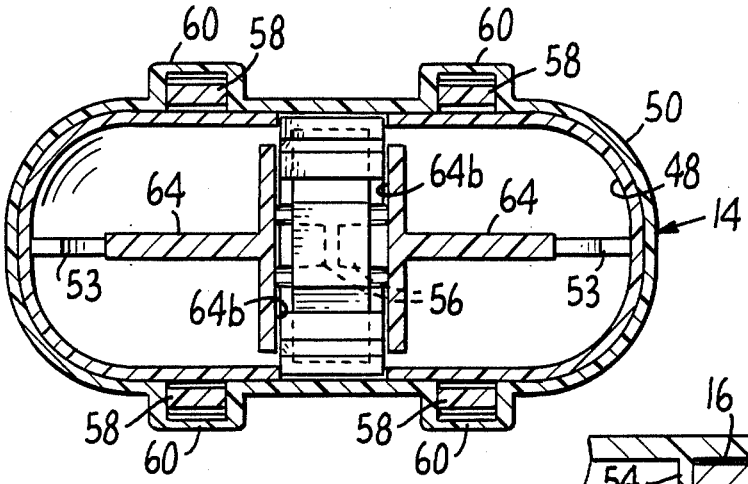
FIG. 7 is a cross-sectional plan view of the subject anchor assembly taken through section line 7—7 of FIG. 5.
Figure 8:
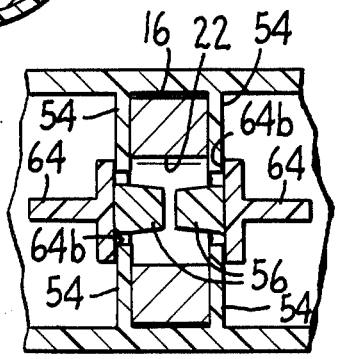
FIG. 8 is a partial cross-sectional plan view of the subject anchor assembly taken through section line 8—8 of FIG. 5.

Lid section 50 further includes a pair of downwardly-extending cam members 64 having a generally T-shaped cross-section. As can best be seen in FIGS. 7 and 8, cam members 64 each include a first wall member (not designated) aligned with the principle axis of the lid section and a second wall member transverse to the first wall member. The aligned wall members are provided with opposing inclined cam surfaces 64*a* (FIG. 5). The transverse wall members define a second pair of opposing parallel cam surfaces 64*b* which are spaced apart a distance slightly greater than the spacing between opposing walls 54 of body section 48 (FIG. 7). Lid section 50 further includes four vertical locator rods 66 which are spaced around the perimeter of the lid.

Having described a preferred embodiment of the subject anchor assembly, operation of the assembly will now be given. An anchor member 16 is selected having a length which is appropriate for the thickness of the wall slab to be cast. An anchor pin 18 is then inserted into bore 20 of the anchor member. Pin 18 may be either force fitted or slip fitted in bore 20. The bottom portion of the anchor member is then inserted into the rectangular opening of base 10, with the anchor pin being aligned with cutouts 42 of the base. A downward force is then applied to the anchor member causing pin 18 to snap in to place as shown in FIG. 4. The walls of central section 28 of the base prevent lateral movement of the pin and flanges 46 tend to prevent the pin from pivoting. Stop member 41 engages support surface 72 when a downward force is applied to the base thereby preventing the base from flexing an inordinate amount. The stop member returns to the normal spaced-apart position when the force is removed.

Body section 48 of the recess former is then positioned over anchor member 16 with opening 52 being aligned with the member. The body section is moved downwards until the top converging surfaces 16*a* of anchor member 16 engage stop members 62 as shown in FIG. 3. During the insertion process, pivoting locking members 56 are momentarily deflected away from opening 52 by the anchor member and then pivot back into bore 22 of the anchor member when the body section is in position. Next, lid section 50 is positioned over body section 48 with the lugs 58 of the lid section being aligned with the corresponding receiving member 60. The lid section is then lowered until the lugs have fully engaged the receiving members with lip 57 being engaged in groove 55 so as to effect a seal.

The downward movement of the lid section causes cam surfaces 64*a* of cam member 64 to engage the corresponding locking members 56, causing the resilient members to further pivot into opening 52 of the body section and bore 22 of anchor member 16. Vertical surfaces 64*b* of cam member 64 abut the associated locking member when the lid section is snapped in place thereby retaining the locking member in bore 22 so as to lock the lid section to the anchor member.

The anchor assembly is then positioned as a single unit within the horizontal mold (not shown) for the concrete slab at the appropriate position with the base 10 resting on the bottom of the mold. Typically, more than one anchor assembly is used. Anchor member 16 is then fastened to one or more adjacent reinforcing bars (not shown) using wire or the like. The wire is wrapped around the central portion of the anchor member in cutouts 24.

When all of the anchor assemblies are secured in place, concrete is poured into the mold. The wet concrete will have a tendency to cause the recess former 14 to float. However, recess former 14 will remain secured to anchor member 16 by virtue of locking members 56. The concrete is poured until the concrete just covers the top surface of lid section 50, as represented by line 70.

Once the concrete has cured, each of the anchor assemblies is located by observing rods 66. The thin concrete layer above the lid section is then removed. Next, the lid section is separated from the body section of the recess former. This permits locking members 56 to pivot out of bore 22 of the anchor member 16. The body section of the recess former is then removed by gripping webs 53 with a pair of pliers and pulling the body section away from the slab. The resultant void provides access to the top portion of anchor member 16 including bore 22 of the member.

A hoisting attachment is then secured to each of the anchor members and the slab is tilted up to a vertical position. Anchor pin 18 ensures that the anchor is not pulled out of the wall slab during the lifting process.

FIG. 2 shows the slab 68 is a vertical position with the hoisting attachment, generally designated by the numeral 74, still engaging the anchor member. As described in U.S. Pat. No. 4,367,892, the entire contents of which are hereby incorporated by reference, the hoisting apparatus includes a plate-like shackle 76 which is connected to a crane cable 78. Shackle 76 is coupled to a ring clutch which includes an outer annular member 80 which has a slot for accepting the end of the anchor member. The clutch also includes a locking bolt 82 rotatable within the annular member which extends through bore 22 of the anchor member. The hoisting apparatus is disengaged from the slab by lowering cable 78 thereby permitting the shackle to pivot downwards, out of engagement with the operating lever of locking bolt 82. A line 84 attached to the locking bolt is then pulled causing the operating lever to pivot downwards, and rotate within annular member 80. Rotation of bolt 82 causes the bolt to disengage from the anchor member thereby causing the hoisting attachment to release.

Thus, a novel anchor assembly has been disclosed. Although a preferred embodiment of the assembly has been described in some detail, it is to be understood that various changes could be made by persons having average skill in the art without departing from the spirit and scope of the invention as defined by the appended claims.

We claim:

1. An anchor assembly for use in raising a tilt-up wall section comprising:

an anchor pin having a generally circular cross section;

an elongated anchor member which is provided with first and second transverse bores near first and second ends, respectively, of said elongated member, with said anchor pin being disposed in said first bore;

base means for receiving said first end of said elongated member and for supporting said elongated member in a generally vertical position, said base means including two pairs of first opposing resilient members, with each pair of said first resilient members being disposed on opposite sides of said anchor member and extending at least partially around said anchor pin; and recess forming means disposed over said second end of said anchor member for forming a recess in the wall section which exposes said second bore of said anchor member.

2. The anchor assembly of claim 1 wherein said base means further includes stop means for preventing lateral movement of said anchor pin.

3. The anchor assembly of claim 1 wherein said recess forming means includes second locking means for detachably locking said recess forming means to said anchor member.

4. The anchor assembly of claim 3 wherein said second locking means engages said anchor member utilizing said second bore.

5. The anchor assembly of claim 4 wherein said second locking means comprises a pair of second opposing resilient members disposed on opposite sides of said anchor member.

6. The anchor assembly of claim 5 wherein said recess forming means includes a body section having an opening for receiving said anchor member and a removable lid section, with said body section having said second opposing resilient members disposed on opposite sides of said opening and said lid section having cam means for engaging said resilient members and for causing said second opposing resilient members to extend into and remain in said second bore so as to lock said recess forming means to said anchor member.

7. An anchor assembly for use in raising a tilt-up wall section which is cast in a horizontal position comprising:

an anchor pin;

an elongated anchor member having first and second bores near first and second ends of said member, respectively, with said anchor pin being disposed in said first bore;

a base having a recess for receiving said first end of said anchor member and first locking means for detachably locking said anchor member to said base, said first locking means including two pairs of first opposing resilient members, said pairs being disposed on opposite sides of said elongated anchor member, with said first opposing resilient members extending at least partially around said anchor pin; and a recess forming means disposed over said second end of said anchor member for forming a recess in the wall section which exposes said second bore of said anchor member, said recess forming means including second locking means for detachably locking said recess forming means to said anchor member, said second locking means including at least one second resilient member which engages said anchor member utilizing said second bore.

8. An anchor assembly for use in raising a tilt-up wall section cast in a horizontal position comprising:

an anchor pin having a generally circular cross section;

an elongated anchor member having a generally rectangular cross section, said anchor member having first and second bores disposed near first and seconds ends of said member, respectively, with said anchor pin being disposed in said first bore;

a base having a first opening for receiving said first end of said elongated member, said base including two pairs of resilient members, said pairs being disposed on opposite sides of said first opening and extending at least partially around said anchor pin, and a pair of stop members at opposite ends of said anchor pin for preventing lateral movement of said pin; and a recess forming member having a second opening for receiving said second end of said anchor member, said recess forming member having a body section with a pair of second resilient members which are pivotable into and out off said second bore of said anchor member and a detachable lid section having a pair of cam members which engage said pair of second resilient members and cause said resilient members to pivot into and remain locked in said second bore when said lid section is secured to said body section.

9. An anchor assembly for use in raising a tilt-up wall section cast in a horizontal position comprising:

a anchor having first and second ends and a bore disposed near said second end;

a base for receiving said first end of said anchor and for supporting said anchor; and a recess forming member having an opening for receiving said second end of said anchor, said recess forming member having a body section with a pair of opposing resilient members which are pivotable into and out of said anchor bore and a detachable lid section having a pair of cam members which engage said pair of resilient members and cause said resilient members to pivot into and remain locked in said bore when said lid section is secured to said body section.

10. The anchor assembly of claim 9 wherein said anchor comprises:

an anchor pin having a generally circular cross section; and an elongated anchor member which defines said first and second ends of said anchor, with said anchor bore being disposed near said first end and further including a second bore near said second end, with said anchor pin being disposed in said second bore.

11. An anchor assembly for use in raising a tilt-up wall section comprising:

an anchor pin;

an elongated anchor member which is provided with first and second transverse bores near first and second ends, respectively, of said elongated member, with said anchore pin being disposed in said first bore;

base means for receiving said first end of said elongated member and for supporting said elongated member in a generally vertical position; and recess forming means disposed over said second end of said anchor member for forming a recess in the wall section which exposes said second bore of said anchor member, said recess forming means including a body section and a lid section which seals said body section and locking means for detachably locking said recess forming means to said anchor member, said locking means including a pair of opposing resilient members which extend into said second bore when said lid section seals said body section.

12. A recess former of an anchor assembly used for raising a tilt-up wall section, with the assembly including an elongated anchor member supported on a base at a first end of the member and having a bore at a second end thereof, said recess former comprising:

a body section having an opening for receiving the second end of the anchore member and opposing resilient members disposed on opposite sides of said opening; and a removable lid section having cam means for engaging said resilient members and for causing said opposing resilient members to extend into and remain in the bore so as to lock said recess former to the anchor member.

* * * * *